US006792701B1

(12) United States Patent
Ruffini et al.

(10) Patent No.: US 6,792,701 B1
(45) Date of Patent: Sep. 21, 2004

(54) FOOTWEAR PRODUCT FOR THERAPEUTICALLY TREATING THE SKIN

(76) Inventors: Linda Ruffini, 2620 SW. 52nd Ter., Cape Coral, FL (US) 33914; Christine Antle, 1711 Hough St., Fort Myers, FL (US) 33901

( * ) Notice: Subject to any disclaimer, the term of this patent is extended or adjusted under 35 U.S.C. 154(b) by 21 days.

(21) Appl. No.: 10/396,092

(22) Filed: Mar. 26, 2003

(51) Int. Cl.[7] ..... A43B 23/17

(52) U.S. Cl. ..... 36/98; 36/9 R; 36/140; 36/1; 604/293; 424/402

(58) Field of Search ..... 36/98, 9 R, 140, 36/1

(56) References Cited

U.S. PATENT DOCUMENTS 2,664,087 A * 12/1953 Lewis ..... 36/9 A
3,218,737 A * 11/1965 Burtoff ..... 36/50.1
3,749,091 A * 7/1973 Basa ..... 604/293
3,896,807 A * 7/1975 Buchalter ..... 424/402
4,257,176 A * 3/1981 Hartung et al. ..... 36/44
4,622,035 A * 11/1986 Palmer et al. ..... 604/293
5,682,617 A * 11/1997 Tumas ..... 604/293
6,705,026 B1 * 3/2004 Arbour ..... 36/8.3
2003/0171724 A1 * 9/2003 Carter ..... 604/293

* cited by examiner

*Primary Examiner*—Ted Kavanaugh

(57) ABSTRACT

A footwear product is provided for therapeutically treating the skin of the wearer's feet. The footwear includes a three layer sole including a lower layer of polyester foam, a middle layer of polypropylene foam and an upper layer of a thin film of polyethylene. The upper is constructed of the same material as that of the sole with the thin film of polyethylene lacing the inside of the slipper. The upper and the sole are connected to each other either by sewing or by heat welding. A medicated emulsion or cream is applied to the inner surfaces of the slipper without penetrating to the outside of the slipper

9 Claims, 3 Drawing Sheets

FOOTWEAR PRODUCT FOR THERAPEUTICALLY TREATING THE SKIN

CROSS REFERENCES TO RELATED APPLICATIONS (none)

STATEMENT REGARDING FED SPONSORED R & D (none)

BACKGROUND OF THE INVENTION

This invention relates to an item of footwear such as a slipper that is so constructed and treated for aleviating skin problems experienced by the sole and/or heel of the wearer's foot. For this purpose, the slipper includes an interior pad which carries a therapeutic formulation for contact with the skin of the foot.

Many people suffer from cracked or otherwise irritated dry skin on their feet and other areas of the body. The elderly, persons with skin conditions, athletes and workers who have to spend much time on their feet are particularly susceptible to such problems. Currently, topical foot ailments are most commonly treated by applying various types of creams, oils, ointments or lotions to the sole and heel of the feet as needed. This is obviously a messy, tiresome and time consuming procedure. It also appears to be a treatment of short duration because the other cover has to be worn over the treated area so that no floor coverings of the floors themselves can be soiled.

Thereby, the ointments are quickly transferred to the other foot coverings. Older persons and those with physical limitations may have considerable difficulty reaching their feet to apply any therapeutic medications. Oftentimes, such individuals require the assistance of a caretaker or other person to apply the treatment.

Footwear, and more particularly a sock, carrying a therapeutic additive for treating the skin has been developed. See Gould, U.S. Pat. No. 6,117,119. This reference discloses a tube sock having a gelatinous elastomeric composition intimately bonded to an interior of the sock. Unfortunately, this results in a messy and impractical product.

This type of sock cannot be readily tread upon because the bonded gelatinous Addative tends to seep through the cloth sock material. It the wearer attempts to walk, he or she may slip on a tile, wood or vinyl floor surface. This product is likewise impractical to wear under a shoe, in a shoe or other footwear. By the same token, after a very limited period of use, the sock becomes quite soiled and essentially unusable. Cleaning the medicated sock is quite impractical because the medication would be washed out and the reference does not teach how the medication could be replenished.

SUMMARY AND OBJECTS OF THE INVENTION

It is therefore an object of the invention at hand to provide a therapeutic footwear product that effectively and efficiently applies a therapeutic composition to the wearer's skin of the foot.

It is a further object of this invention to provide a therapeutic footwear product that automatically applies a therapeutic additive to the foot while the product is worn and which eliminates the need for the wearer to apply such an additive to his or her feet by hand or by employing the assistance of a caretaker or other person.

It is a further object of this invention to provide a therapeutic footwear product that is more efficient and practical to use than known products and which allows the wearer to walk safely on virtually all types of floor surfaces without slipping.

It is further object of this invention to provide a therapeutic footwear product that which, unlike known products avoids becoming prematurely soiled and unusable.

It is a further object of this invention to provide a therapeutic footwear product that is unlike known products, is efficiently disposable after a brief or limited use.

It is a further object of this invention to provide a therapeutic footwear product that effectively separates the therapeutic from the exterior body of the footwear so that problems of the prior art are avoided It is a further object of this invention to provide a therapeutic footwear product that utilizes a much improved skid resistant bottom surface.

It is a further object of this invention to provide a therapeutic footwear product that is lightweight and quite comfortable and convenient to use.

It is a further object of this invention to provide a therapeutic footwear product that is very convinient to put on or take off.

It is further object of this invention to provide a therapeutic footwear product that is convenient to use both at home or in a hospital or other health care environment It is a further object of this invention to provide a therapeutic footwear product that effectively treats dry, cracked or otherwise topically damaged skins on feet and, at the same time, retains warmth and moisture so that the skin on the foot is beneficially treated in a manner much improved over the prior art.

The invention at hand is the result of a realization that a greatly improved therapeutic footwear product may be achieved by forming an outer skid resistant foam footwear product in the form of a lightweight slipper and mounting within said product a distinct pad carrying a lubricating or medicating composition and separated from the slipper by a barrier that prevents the composition from penetrating to the exterior of the slipper. This keeps the slipper clean, improves friction and prevents potentially hazardous slips and falls.

This invention features a therapeutic footwear product for treating dry, cracked or otherwise damaged skins on feet. An outer slipper is provided for receiving the wearer's foot and for covering at least the heel, sole and toes of the foot. An inside surface of the slipper carries a flexible film for directly engaging the skin of the wearer's heel, sole and toes. The pad carries a therapeutic medium, that is, lubricating or medicating composition such that the pad directly engages the wearer's skin of the foot. A liner is interposed between a bottom surface of the pad and an inner surface of the slipper.

In a preferred embodiment, the slipper is composed of a flexible foam. The pad may be composed of a synthetic fabric The therapeutic composition may comprise various constituents designed to provide therapy to hot, dry, cracked sore or otherwise irritated or chapped skins on feet. A preferred formulation includes melted bees wax that is mixed with olive oil, jojoba oil, aloe vera oil, tea tree oil and rosemary essential oils. Other essential oils that may be used to soothe various foot problems may include peppermint, tangerine oil, geranium; lemon, mandarin, myrrh, orange, ylang ylang, palmarose, frankencense, marjoram and rosewood. Lanolin oil, cocoa butter, sweet almond oil, shea butter, grape seed oil and vegetable oils may also be employed and used. Vitamins such vitamins E, C, and A may similarly be added to the formulation.

A removable film covering may be applied to the upper surface of the slipper. That is, the opening where the foot enters the slipper. This is important because it will lengthen the shelf life of the product considerably. This is so, because this way the formulation will not be exposed to the ambient air until it is used. This will help the shelf life even so the slipper or slippers are packaged in so-called shrink packages.

The slipper or slippers preferably comprise a very low cost and easy to manufacture foam. As a result, the footwear product may be readily disposable between uses. Due to the low cost nature of the product, acceptable efficiency is maintained.

DETAILED DESCRIPTION OF THE INVENTION

Figure 1:
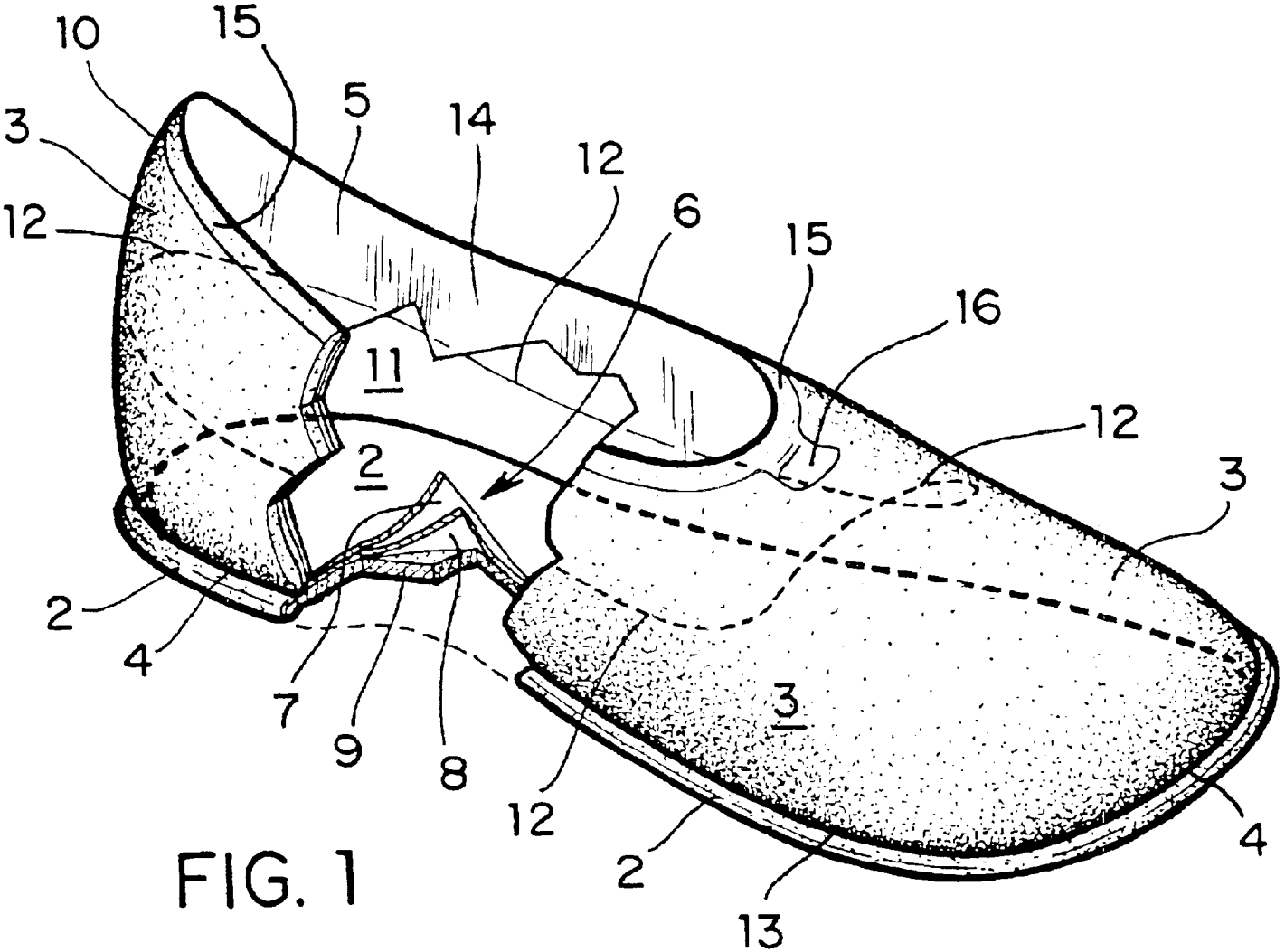
FIG. 1 shows a perspective and broken away view of the therapeutic slipper.

There is shown in FIG. 1 a therapeutic footwear product 1 that is worn by a user's foot. The therapeutic footwear 1 is designed primarily for therapeutic use, although the particular environment in which this product is used is not a limitation of this invention. For example, footwear 1 may be utilized in a hospital, rehabilitation center or other health care facility. Alternatively, the footwear product may be employed at the user's home or in other non-medical locations. The slipper 1 is constructed of only two components, that is a sole 2 and an upper 3. The sole 2 and the upper 3 may be combined by either stitching or by a heat sealed welt at the heel of the sole. The upper 3 has an opening 5 therein so that a foot of a user may enter into the slipper. The inner sole 6 is of a three layer construction. The upper layer 7 is a polyethylene film which is adhered to the middle layer 8 is a polypropylene foam and the lower or bottom layer is polyester foam. The bottom layer is under the slipper and is used to walk on the floor surface. By nature, this surface is substantially slip proof. The whole upper 3 is made from the same three layer composition as the sole. Therefore, the sole and the upper can be combined by heat welding because of the synthetic nature of the material. The heel around the heel of the wearer is somewhat raised in the back at 10 to increase comfort and the retention of the slipper on the foot of the wearer. In order to attain the therapeutic value of the slipper, an emulsion is applied to the inner sole 6 and somewhat to the inside of the upper. At 12 is shown the suggested upper limit to which the emulsion should be applied. This includes the inside of the upper over the toe area. The composition of the emulsion will be explained below and has already been explained to some extent in the paragraph under the heading "Summary". The edge 13 of the opening 5 for the foot should also be finished by either sewing with a serger sewing machine or a heat sealed wedge.

It is also important to cover the opening 5 with a clear plastic sealing cover 14 to prolong the shelf life of the footwear when sitting in a store ready for sale or to prevent the interior emulsion to come in contact with any other items when the slipper is collapsed such as in a package. The cover has an adhesive sealing edge at 15 which will adhere the cover 14 to the edges of the opening 5 of the upper 3. For ease of handling there is provided a pull tab so that the cover 14 can easily be removed from the upper 3.

Figure 2:
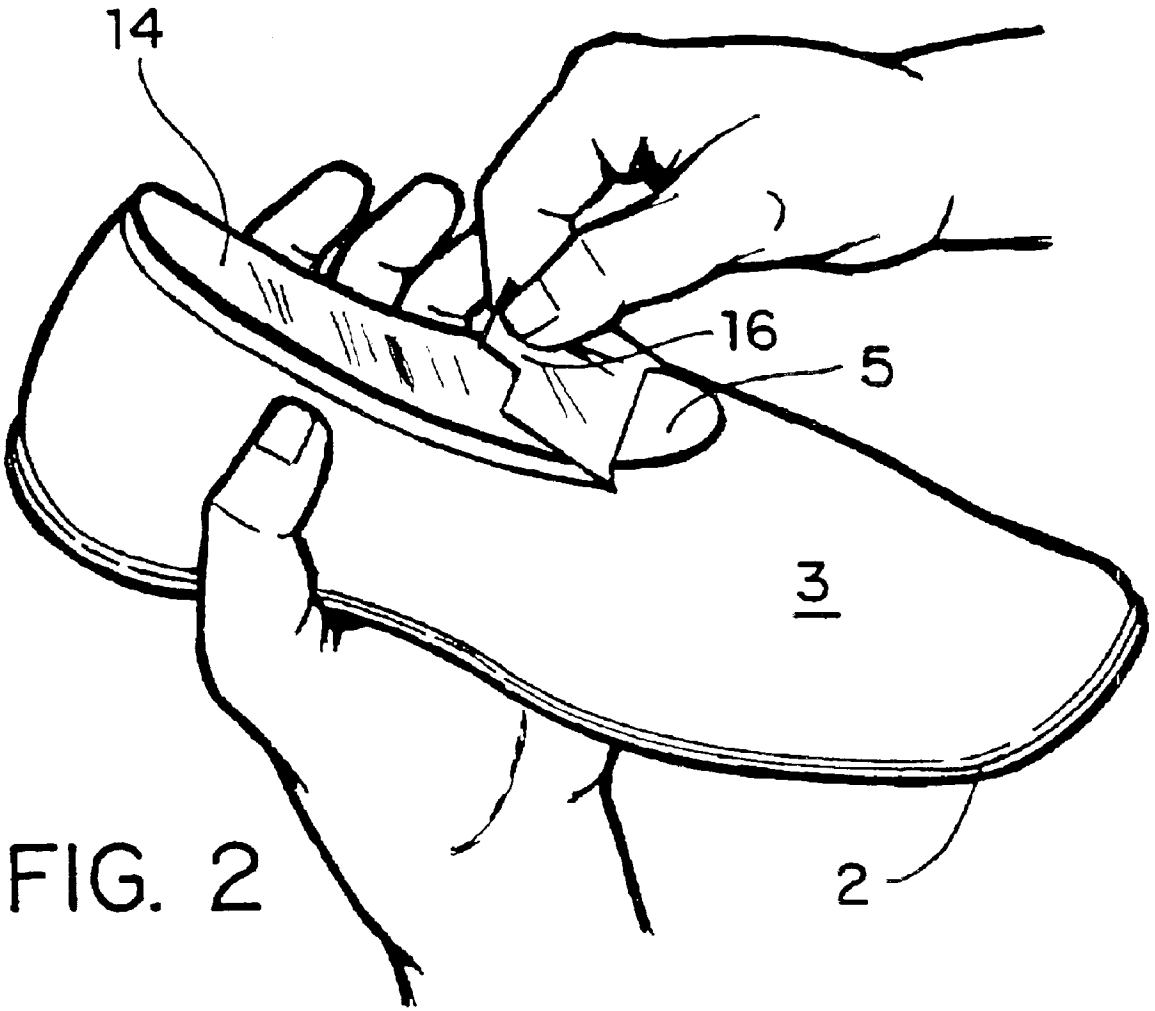
FIG. 2 shows a perspective and top view of the slipper with a protective cover.

FIG. 2 more clearly explains and illustrates the use of the clear plastic cover 14 on the opening 5 of the upper 3.

Figure 3:
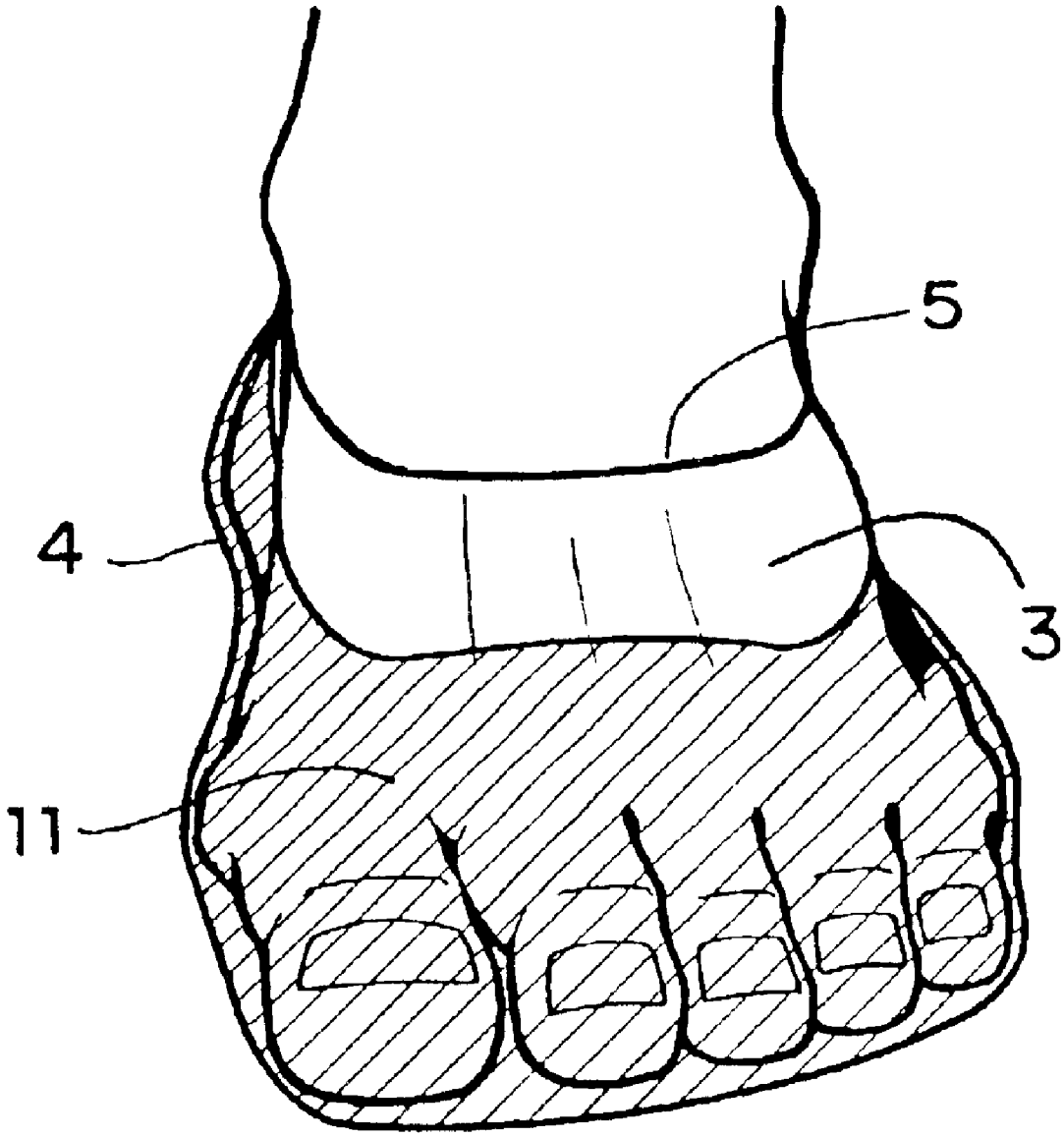
FIG. 3 shows a perspective and front view of the slipper

FIG. 3 illustrates the front area of the slipper and the extent of the application of the emulsion over the toe area which is somewhat removed from the opening 5 of the upper 3.

The construction explained above has greatly improved the safety of the user of the footwear because the construction of the footwear, especially in the sole area, the therapeutic emulsion or composition is prevented from reaching the exterior of the slipper so that no lubricating substance can reach the outside to cause the user of the footwear slipping on a floor surface.

The emulsion or composition may comprise a wide variety of treatment ingredients. These may include all sorts of oils, lotions and creams for medicating and/or lubricating the skin of the wearer's feet. A preferred formulation is as follows:

| INGREDIENT | AMOUNT |
|---|---|
| Melted Bees Wax | 1 oz. |
| Olive Oil | 4 tablespoons |
| Jojoba Oil | 4 tablespoons |
| Vitamin E | 1 tablespoon |
| Aloe vera Oil | 1 tablespoon |
| Tea Tree Oil | 20 drops |
| Rosemarie Essential Oils | 20–30 drops |

The foregoing ingredients are mixed vigorously together until the composition is creamy. This produces approximately ½ cup of the therapeutic composition. Greater or smaller amounts may be produced may varying ingredient amounts proportionally. The finished product is applied or introduced into the treatment area, such is the inner sole or part of the inside of the upper.

Alternative and or additional ingredients may be added to provide a desired treatment for tired, sore. chapped, peeling, cracked and/or dry feet. for example, peppermint essential oils are especially effective for use on tired feet. The following is a list of various constituents that may be added to the composition:

| | | |
|---|---|---|
| Lavender | Myrrh | Lanolin Oil |
| Tangerine Oil | Orange | Cocoa Butter |
| Grapefruit | Ylang ylang | Sweet almond Oil |
| Jasmine | Palmarose | Shea Butter |
| Geranium | Frankincense | Grape Seed Oil |
| Lemon | Marjoram | Castor Oil |
| Mandarin | Rosewood | Vegetable Oil |

Vitamin additives proven to be effective include Vitamines E, C an A.

The footwear product of this invention provides significant advantages over the existing prior art. The foam slipper of the present invention also helps to significantly retain moisture and heat. This provides even further therapeutic benefits, particularly to persons suffering from raw, cracked or dry skin on their feet.

From the foregoing it may be seen that the footwear of this invention provides for an item of footwear, more particularly, a hospital type slipper that includes an interior layer for carrying a therapeutic formulation or emulsion for treating skin problems experienced by the sole or heel of the wearer's foot. While the above detailed description has set forth particularly preferred embodiments of the product of this invention, numerous modifications and variations of the structure of this invention, all within the scope of the invention will readily occur to those skilled in the art. Accordingly, it is understood that this description is illustrative only of the principles of the invention and is not limitative thereof.

Although specific features of the invention are shown in some of the drawings and not others is for convenience only, as each feature may be combined with any and all of the other features in accordance with the invention.

What is claimed is:

1. An item of footwear adapted for the treatment of the irritation of the skin of the foot, said item comprising a sole and an upper in the form of a slipper, means for connecting said upper to said sole, said sole includes a three layer construction, a first layer being a bottom layer is a polyester foam, a middle layer is a polypropylene foam and a top layer being adhered to said middle layer is a thin polyethylene film, a medicated emulsion being applied to an upper side of said top layer.

2. The item of footwear of claim 1, wherein said upper is constructed of the same three layer material as said sole with said thin layer polyethylene film facing the inside of said slipper.

3. The item of footwear of claim 1, wherein said means for connecting said upper and said sole is a sewn seam.

4. The item of footwear of claim 1, wherein said means for connecting said upper and said sole is a heat welded seam.

5. The item of footwear of claim 1 including an opening in the top of said upper adapted to receive a foot of a wearer, said opening at its edges being finished by a seam.

6. The item of footwear of claim 5 including a protective cover adhered at its edges to said edges of said opening to close said opening.

7. The item of footwear of claim 6 including a pull tab on said protective cover to ease the removal of said cover.

8. The item of footwear of claim 1, wherein said emulsion includes ingredients selected from the group consisting of: melted bees wax, olive oil, jojoba oil, vitamin E, aloe vera oil, tea tree oil and rosemary essential oils.

9. The item of footwear of claim 8, wherein said ingredients include additives selected from the group consisting of: lavender, Myrrh, lanolin oil, tangerine oil, orange, cocoa butter, grapefruit ylang ylang, sweet almond oil, jasmine, palmarose, shea butter, geranium, frankincense, grape seed oil, lemon, marjoram, castor oil, mandarin, rosewood and vegetable oil.

* * * * *